United States Patent [19]

Fonda

[11] Patent Number: 4,638,211

[45] Date of Patent: Jan. 20, 1987

[54] SHADOW MASK FOR A COLOR IMAGE TUBE AND IMAGE TUBE COMPRISING THE SAME

[75] Inventor: Carlo L. Fonda, Anagni, Italy

[73] Assignee: Videocolor, Montrouge, France

[21] Appl. No.: 673,824

[22] Filed: Nov. 21, 1984

[30] Foreign Application Priority Data

Nov. 25, 1983 [FR] France ..... 83 18853

[51] Int. Cl.[4] ..... H01J 29/07

[52] U.S. Cl. ..... 313/405; 313/407

[58] Field of Search ..... 313/402–405, 313/407, 408

[56] References Cited

U.S. PATENT DOCUMENTS

| | | | |
|---|---|---|---|
| 3,524,973 | 8/1970 | Rigdon | 313/405 |
| 3,808,493 | 4/1974 | Kawamura et al. | 313/404 |
| 4,308,485 | 12/1981 | Ignazio | 313/407 |

FOREIGN PATENT DOCUMENTS

| | | | |
|---|---|---|---|
| 2713246 | 10/1978 | Fed. Rep. of Germany | 313/405 |

OTHER PUBLICATIONS

Patents Abstracts of Japan, vol. 6, No. 144, Aug. 3, 1982, p. 1022E122.

*Primary Examiner*—Palmer C. DeMeo
*Assistant Examiner*—Sandra L. O'Shea
*Attorney, Agent, or Firm*—Pollock, VandeSande & Priddy

[57] ABSTRACT

In a color cathode-ray tube having a perforated mask for the selection of colors, one edge of the mask is fixed to the frame through intermediary of bimetallic strips. The frame is integral with the internal face of the glass wall of the tube adjacent to the screen. The bimetallic strips between the edge of the mask and the frame are disposed along the length of the vertical sides with first bimetallic strips at the center of each of the vertical sides and second bimetallic strips adjacent to the corners. The bending of the bimetallic strips adjacent to the corners is greater than the bending of the bimetallic strip in central position.

9 Claims, 18 Drawing Figures

SHADOW MASK FOR A COLOR IMAGE TUBE AND IMAGE TUBE COMPRISING THE SAME

BACKGROUND OF THE INVENTION

The present invention concerns a shadow mask or color selection electrode for a television image tube or display (visualization) in color (cathoderay tube). It concerns, more particularly, means for attaching the mask to its support framework that are disposed in such a way as to reduce the initial distortion (the swelling or bulging or doming) of the mask under the effect of the heat generated by its electron bombardment.

A shadow-mask tube is generally formed of a glass envelope coprising a front panel (or plate) having a rectangular form, surrounded by a lateral wall in the form of a skirt, which is sealed at a part called the "conical" part which tapers and finishes with a tubular neck, housing at the end an assembly of three electron guns. Around this neck, horizontal and vertical electromagnetic deflectors are provided, allowing to carry out the sweep of the luminescent screen.

This screen, formed of luminescent material of three primary colors, red R, blue B, and green V, is deposited on the internal face of the plate. In a type of tube where the electron guns emit three parallel electron beams situated in a single horizontal plane, this screen is constituted by a repetitive succession of three vertical bands of luminescent material of three different colors R, V, B.

The color selection electrode is constituted by a metal surface provided with a great number of oblong (or elongated rectangular) openings; it is called a shadow-mask and is disposed on the path of the three electron beams adjacent to, and substantially parallel with, the screen. This mask has the effect of allowing to pass only that part of each electron beam which is directed towards a single band of luminescent material R, V and B, so that one beam is intended to hit the green bands, another beam only reaches the blue bands B and the last beam only bombards the red bands R; the selection is obtained due to the difference of the incident angles of the beams at the site of the slots. But the major part (about 80%) of the electrons of each beam hit the mask without crossing through the slots. This means that a rapid heating occurs at the part of the mask swept by the beams.

Since the mask must, during the manufacturing of the tube, be removed and put back into place several times and, furthermore, be capable of supporting predetermined mechanical shocks and vibrations, without undergoing permanent distortions or displacements, it is generally supported by means of a fixed metal frame which is, preferably, constituted by a profiled piece having an L-shaped cross-section and a thickness substantially greater than that of the mask (by 10 to 15 times, for example). The thickness of the mask is generally between 100 and 200 micrometers, and that of the frame between 2 and 3 millimeters. These values depend, of course, upon the dimensions of the screen.

Due to this fact, the thermal inertia of the frame is much higher than that of the mask; this frame is thus heated only much more slowly. Therefore, the shadow mask is, once the tube operates, heated much more quickly than the heavy and thick frame. This frame itself is attained only slightly by the electrons, which generally contact it only in the vicinity of the beginning and the end of each line sweep and each frame sweep.

Consequently, it is mainly heated from the mask and it only reaches its equilibrium temperature much later than the mask. A swelling or bulging called "doming of the mask" is thus observed, the central part of which approaches the screen and the edges of which, being welded to the frame, are fixedly maintained in position by it. The frame is itself secured to the skirt of the front panel only by conventional assembly means having spring blades. This temporary swelling of the perforated mask causes displacements of the slots which, in the center, are exclusively axial; they present axial components decreasing from the center towards the periphery (where they are initially zero) and radial components which increase from the center (where they are zero) until about half-way between the center and the edge (where they reach their maximal values) and from there said components decrease towards this periphery. This situation is diagrammatically illustrated in the sectional view of FIG. 1, where a curve A in dashed line shows the profile of a cold mask 12 and a cold frame 16, while a curve B in mixed lines shows the profile of a hot mask 12 with a cold frame 16 causing the said swelling. The above-mentioned displacements of the slots have the effect of displacing the axes of those portions of the beams which cross through them with respect to the vertical axes of the bands of luminescent material R, V and B, associated in juxtaposed triplets, in such a way as to cause register losses, or alignment defects, that are the highest in an annular zone located about mid-way between the center and the edge of mask 12.

This can result in either a relative decrease of the luminous intensity substantially proportional to that of the surface of the bombarded luminescent material (if the bands are separated by phosphorus-free zones), or defects of color purity, since a beam intended for a single luminescent material hits partially an adjacent band of another color.

After a selected operating time of the tube, the frame 16 is also heated progressively, by conduction, by radiation and possibly by electron bombardment. Since the frame 16 and mask 12 are generally made of the same material (laminated steel), they present the same thermal expansion coefficient. The expansion of frame 16, resulting from that of mask 12, has the effect, on the one hand, of reducing its swelling (by flattening it with respect to the curve B of FIG. 1), and on the other hand, of increasing the shift between its slots, i.e. of displacing them radially. This is diagrammatically illustrated in the sectional view in FIG. 2, which shows (curve A in dashed line, analogous to that of FIG. 1) the profile of a cold mask-plus-frame assembly and (curve C in full line) a hot mask-plus-frame assembly, i.e. a mask and frame having reached a same equilibrium temperature. It is observed that the size of mask 12 as well as the shift between the pairs of parallel arms of frame 16 have increased and that the radius of curvature of mask 12, after a brief reduction due to the initial swelling, becomes slightly higher than that which had prevailed in the cold state. If frame 16 is suspended solely by using spring blades, the longitudinal axes of which are positioned in a single median (transversal) plane and are substantially tangential with respect to its circumference, frame 16 can expand in its plane without undergoing any axial displacement. This has the effect of stretching the surface of the mask so that it spreads out by flattening slightly. Mask 12 thus undergoes a slight axial displacement at the center which increases with the radial distance, and a spreading out in the radial direction which has the effect of producing an increase of the spacing of the slots and, to a lesser extent, an increase of their width. This results in register losses due to the spreading out of the slots in the plane of the expanded surface, which increase with their radial distance with respect to the axis of the tube (i.e. with respect to the center of the mask 12). It has been determined that a supplementary displacement of the hot mask 12-plus-frame 16 assembly (profile C) in the direction of the screen by following the axis of the tube, allowed to compensate these register losses, such a displacement allowing substantially to maintain the center of curvature of the surface of mask 12 at the intersection of the axis of the tube with the deviation plane perpendicular to this axis. This axial displacement towards the fore, illustrated by profile D (without frame) in FIG. 2, is obtained either by blade springs (cf. for example, French Pat. No. 1 540 869), or by using bimetallic strips components inserted between one end of the blade spring and frame 16. However these bimetallic compensation elements are not involved during the initial swelling of mask 12. This swelling can be especially reduced, as well as other distortion effects exerted on the edges of mask 12, by limiting the number of welding sites or sealings joining the skirt of the mask 12 to the belt of frame 16 that are parallel, as disclosed in French pat. No. 1 470 260.

Various arrangements have allowed supplementary reductions of initial swelling to be achieved both in amplitude and duration. In particular, it is possible with this purpose, to utilize a frame of reduced thickness, strengthened by at least one rib or fold in order to present sufficient mechanical strength. It is also possible, and this is the system used in the present invention, to use bimetallic strips as intermediary attachment means between the mask and the lateral wall of a frame.

But this known solution does not, as such, reduce the temporary swelling sufficiently for certain applications such as the display in computers (for example, videography) or in high definition television. In fact, these tubes present screens with finer luminescent material bands and masks with slots spaced closer together (interval reduced from 0.8 to 0.5 millimeters, for example) than in current tubes, and consequently which have much more tighter tolerances on the radial displacements of the slots. It will also be noted that if the radius of curvature is increased, so that it is flatter, the register loss is also increased due to the swelling. It is well understood that the requirements of temporary swelling reduction of the mask further increase for a flat screen of great resolution.

SUMMARY OF THE INVENTION

According to the invention, bimetallic components are provided between the mask and the frame, substantially at the center of each vertical side, as well as at the four corners, the bending of the strips occurring at the four corners being greater than the bending of the two bimetallic strips substantially at the center of each vertical side. The invention results, in fact, from the observation that the expansion of the mask along the diagonal is greater than that along its horizontal axis of symmetry and that this difference contributes, to a large extent, to the duration and amplitude of temporary swelling of the mask. The greatest bending of the bimetallic strips in the corners is obtained by increasing the difference between the thermal expansion coefficients of the constitutive alloys of the two metallic strips forming a bimetallic component; the different bendings can also be obtained by different lengths of the bimetallic components in the corners with respect to the component at the center.

When the screen presents continuous vertical bands of luminescent material the bimetallic component can be provided uniquely on the vertical sides, while the horizontal sides of the edge of the mask are welded to the frame by a limited number of sealings or welding spots.

BRIEF DESCRIPTION OF THE DRAWINGS

The invention will be better understood and others of its objects, features and advantages will become more apparent from reading the following description given with reference to the appended drawings, in which.

DETAILED DESCRIPTION OF THE INVENTION

The temporary swelling, upon operating of the tube, of the mask 12 with respect to the frame 16, is in a manner known per se, reduced by rendering possible the expansion in the radial direction of the mask in a manner that is practically independent from that of the frame.

Figure 1:
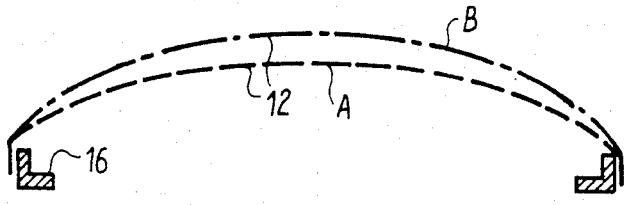
FIGS. 1 and 2 described hereinabove, are diagrammatical sections of the mask-plus-frame assembly of a color television tube.
Figure 2:
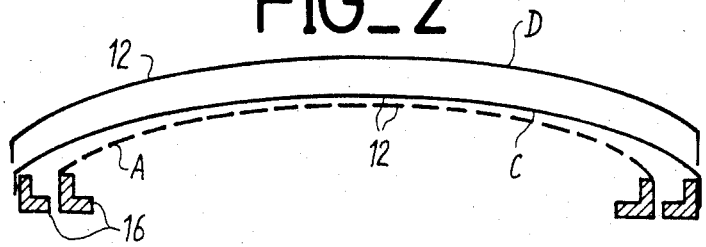
Figure 3:
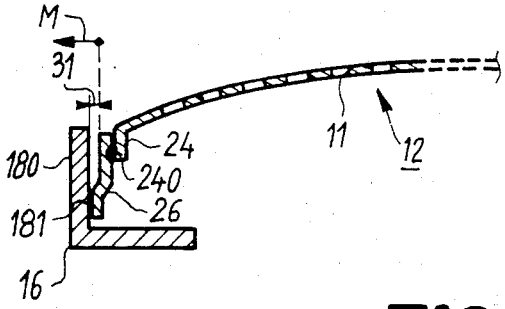
FIG. 3 is a partial sectional view of a mask and a frame assembled by using intermediary bimetallic components.
Figure 4:
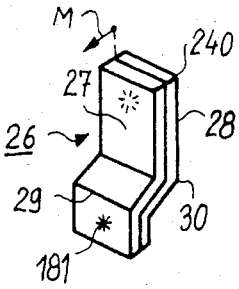
FIG. 4 shows, in perspective, a bimetallic strip of FIG. 3.

FIG. 3 is a partial diagrammatic view of a cross-section of a first embodiment of a mask-plus-frame assembly joined by means of bimetallic strips, and FIG. 4 shows in perspective the bimetallic strip of FIG. 3.

In this example, the frame 16 is slight and thin and the skirt 24 of the mask 12 is short. The frame and the skirt 24 are joined by using several bimetallic tags 26 having an outline and a rectangular section each of which is comprised of two metallic blades 27, 28 (FIG. 4) superimposed and welded together and which are respectively made of metal alloys having different thermal expansion coefficients. One of the blades 27, one end of which is welded at a point 181 to the belt 180 of the frame 16, is preferably made of a nickel alloy (30–40% for example) and iron, having a low thermal expansion coefficient (and generally known under the denomination INVAR). The other blade 28, one end of which is welded at a site 240 to the skirt 24 of the mask 12 is made of steel, for example cold laminated steel (like the mask and the frame) and presents a high thermal expansion coefficient.

At one site 29 above the welding spot 181, the tag 26 is folded towards the axis according to a transversal line and at another site 30 slightly above the previous one, it is again folded towards the edge, in order to obtain, on the one hand, a spacing 31 between the belt 180 and the top of the tag 26 and, on the other hand, when the bimetallic strip or tag is heated, a straightening which allows the mask 12 to maintain at the same level or to cause it to advance slightly towards the screen during its expansion.

When the mask 12 is heated, its edge and its skirt 24 start to heat the tag 26 the internal strip 28 of which expands more than the outside blade 27, so that it bends towards the outside while reducing the spacing 31 and drawing the edge of the mask 12 towards the outside. The displacement of the welding spot 240 with respect to the spot 181 is indicated in FIGS. 3 and 4 by an arrow M. The bimetallic strips 26, constituting the intermediary connecting means between the frame 16 and the skirt 24 of the mask 12, thus encourage practically from the beginning of operating its expansion in the radial direction while substantially reducing the swelling due to the confinement obtained by the still cold frame. They can be placed in all the sites provided in the state of the art for welding spots between the frame and the skirt, especially when it concerns a mask with holes with a screen of luminescent dots disposed in triads and with electron guns disposed in "delta" formation.

For a lined trichrome screen and a rectangular mask with slots, there are theoretically no register defects in the direction of the triplets (i.e. vertical); it is therefore sufficient to utilize the bimetallic tabs 26 solely for the vertical sides; the top and the bottom of the skirt 24 of the mask 12 being, preferably, directly welded, for example in 2, 3 or 4 spots, to the lateral wall 180 of the frame 16, in order to reduce costs.

Figure 5:
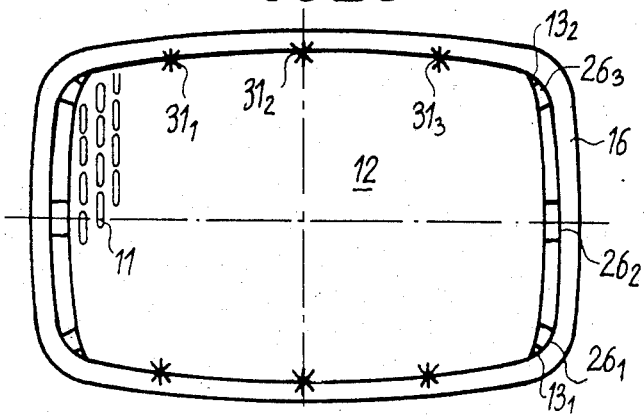
FIG. 5 is a diagrammatical frontal view indicating the sites of the bimetallic strips, according to the invention.

FIG. 5 is a diagrammatic front view indicating respectively the sites of the connecting tabs 26, and the sealings, of a mask-plus-frame assembly according to the invention.

Each of the vertical sides, left and right, of the skirt of the mask 12 with slots 11 is joined to the adjacent side of the belt 180 of the frame, by means of three bimetallic tabs 26, one of which $\mathbf{26_2}$ is disposed in the middle of the side involved and the two others $\mathbf{26_1}$ and $\mathbf{26_3}$, symmetrically on either side of the middle adjacent to the corners $\mathbf{13_1}$ and $\mathbf{13_2}$.

The expansion of the mask 12 in the diagonal direction being higher than that in the direction of its axis of horizontal symmetry, a greater bending is chosen for the bimetallic strips $\mathbf{26_1}$ and $\mathbf{26_3}$ positioned in the corners than for the bimetallic strip $\mathbf{26_2}$. This greater bending can be obtained especially by increasing the difference between the thermal expansion coefficients of the respective constitutive alloys of the two plaquettes 27, 28 superimposed and joined to each other. It is also possible to cause to vary the length of the tag 26 in order to obtain a smaller or greater displacement of its end fixed to the skirt 24.

The long horizontal sides of the frame and the skirt are directly joined together, for example, by three sealings $\mathbf{31_1}$, $\mathbf{31_2}$ and $\mathbf{31_3}$ one of which $\mathbf{31_2}$ is in the middle and the two others $\mathbf{31_1}$ and $\mathbf{31_3}$ are situated symmetrically on either side of this middle. Experience has shown that it can be advantageous to place sealings $\mathbf{31_1}$ and $\mathbf{31_3}$ at distances from the middle $\mathbf{31_2}$ that are smaller by one quarter than the total length from the top or the bottom of the skirt, with the aim of reducing any possible curvilinear distortion of the elongated shape of the slots 11.

FIGS. 6, 8, 10, 12, 14 and 16 are partial sectional views of other embodiments of the mask-plus-frame assemblies using bimetallic strips having other forms, and FIGS. 7, 9, 11, 13, 15 and 17 are views in perspective of these bimetallic strips utilized in the assemblies of the figures mentioned hereinabove.

Figure 6:
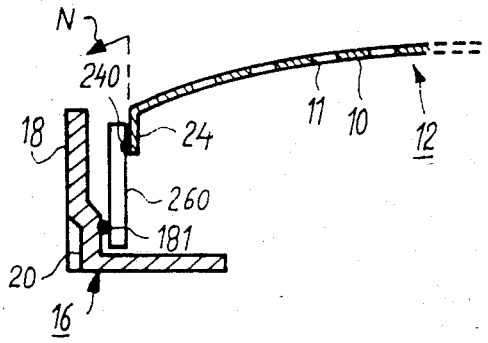
FIGS. 6, 8, 10, 12, 14 and 16 are partial sectional views of other embodiments of the assemblies of the mask and frame using bimetallic strips.
Figure 7:
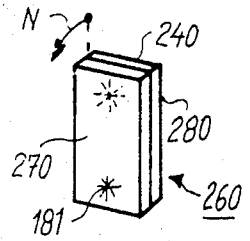
FIGS. 7, 9, 11, 13, 15 and 17 are views in perspective of the bimetallic strips of the assemblies of the figures respectively 6, 8, 10, 12, 14 and 16.

In FIG. 6, a frame 16 has been utilized, the lateral wall 18 of which is provided in its lower portion with strengtheners or hollows 20 which constitute projections towards the inside of this lateral wall 18 regularly spaced apart, so that the plane defined by the internal surface is spaced apart from the rest of the internal face of the wall 18 in such a way that it is sifficient to allow the utilization of the flat bimetallic strips 260 shown in FIG. 7. Each bimetallic component comprises a strip 270 of low expansion and a strip 280 of high expansion which are superimposed and joined to each other, the first 270 of which is joined by its lower end to the internal face of the hollow 20, by a sealing 181 and the second of which 280, is joined by its upper end to the external face of the skirt 24, by another sealing 240. When it is heated, the bimetallic component 260 undergoes a bending towards the exterior, analogous to a pivoting in the direction of the arrow N around its point of fixation 181 to the frame 16.

Figure 8:
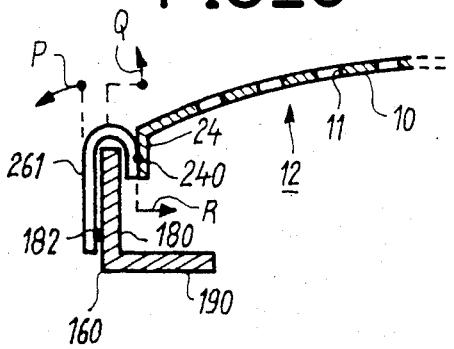
Figure 9:
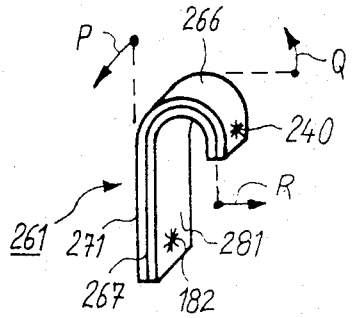

FIGS. 8 and 9 represent in section a bimetallic component 261 the top of which is bent in such a way as to form a semi-cylindrical portion 266. The lamina of low expansion 271 is on the outside of the semi-cylinder, while that of high expansion 281 is inside. The lower end of the straight section 267 of the bimetallic component 261 is welded, at a sealing 182, by the free face of the lamina 281 to the outside face of the lateral wall 180 adjacent to the site of its junction to the base 190. The end of the bent portion 266 which straddles the top of the lateral wall 180 of the frame 160, is joined by the free face of the lamina 271 to the external face of the skirt 24 by means of another sealing 240. The tab 261 thus presents a general form analogous to a hook. When the skirt 24 of the mask 12 starts to heat the end of the bent portion 266, it has a tendency to straighten up or to fold back as indicated by the arrows R and Q. Furthermore, the straight section 267 has a tendency to move away from the lateral wall 180, as indicated by the arrow P. The arrows P and R indicate the displacements in substantially opposite directions but with different lengths, so that the resulting movement is carried out towards the exterior, so as to be opposed to the temporary swelling. The component of the movement towards the top in the direction indicated by the arrow Q, due to the straightening up of the semi-cylindrical portion 266, presents a favorable effect, since it provokes a moving together of the mask 12 of the screen 9 so as to partially compensate the register loss due to the expansion of the mask 12.

Figure 10:
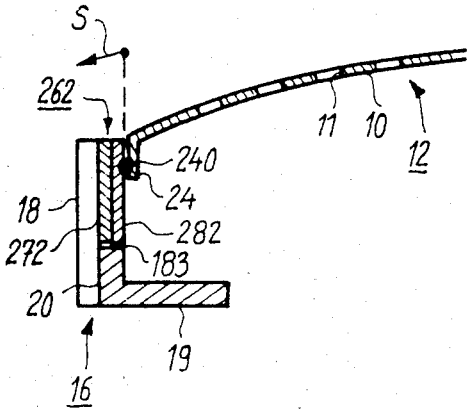
Figure 11:
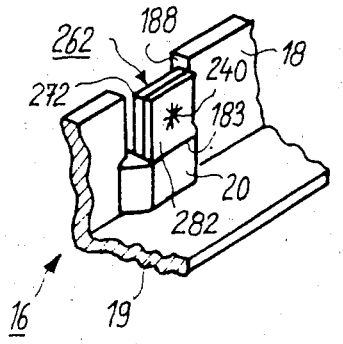

FIGS. 10 and 11 show partially, respectively in section and in perspective, another embodiment of a mask-plus-frame assembly utilizing intermediary bimetallic components. The frame 16 used herein is of the type provided with strengtheners or hollows 20 spaced apart, as represented in FIG. 6.

Above the hollows 20, the lateral wall 18 is provided with cut-outs or steps 188 the flat bottom of which, parallel to the base 19 of the frame 16, is shifted towards the axis of the tube (interior) with respect to the upper edge of the lateral wall 18. By extending the hollow 20, in this flat bottom, the whole of the lower side of a flat bimetallic component 262, analogous to that represented in FIG. 7, is welded in 183. This component 262 comprises a lamina of low expansion 272 turned towards the outside (opposite the axis of the tube) and a lamina of high expansion 282 turned towards the inside, superimposed and joined to each other. The top of the internal face of the tab 262 is welded in 240 to the external face of the skirt 24. Upon the rise in temperature, the sealing 240 is shifted according to arrow S, towards the exterior so that the tabs 262 stretch the mask 12.

FIGS. 3, 5, 6, 8 and 10 show mask-plus-frame assemblies of the type in which the skirt 24 is inside the lateral wall 18, 180 of the frame. In this case, the compensating expansion of the swelling, obtained by using bimetallic strips is limited to the width of the space between the external face of the skirt 24 and the internal face of the belt 18 or 180. This limitation is non-existent in assemblies of the mask type in which the skirt 24 surrounds the lateral wall 180 of the frame.

Figure 12:
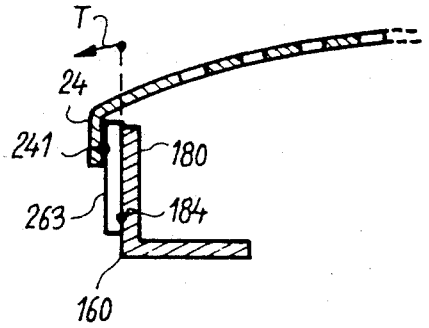
Figure 13:
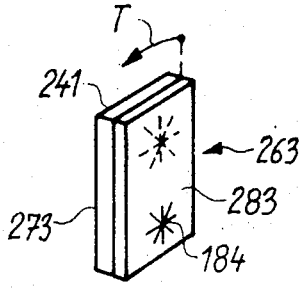

FIG. 12 is a partial section of the most simple embodiment of a mask-plus-frame assembly of the type having an external skirt utilizing a flat bimetallic strip 263, represented in perspective in FIG. 13.

The bimetallic strip comprises a lamina of low expansion 273 and a lamina of high expansion 283, superimposed and joined to each other. The lower end of the free face of the lamina 283 is joined by a sealing 188 to the bottom of the external face of the lateral wall 180 of the frame 160. The top of the free face of lamina 273 is welded in 241 to the internal face of the skirt 24. During the rise in temperature of the bimetallic component 263, the top of said component moves away from the lateral wall 180 of the frame 160, as symbolized by the arrow T.

Figure 14:
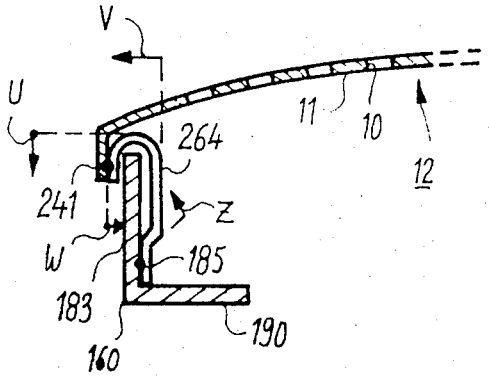
Figure 15:
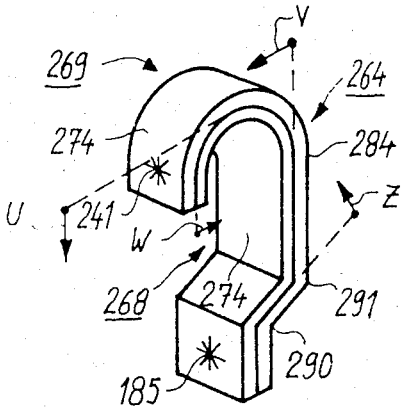

In the embodiment represented in FIGS. 14 and 15, the bimetallic strip 264 comprises a substantially straight lower portion 268 provided with two transversal folds 290 and 291 in opposite directions to ensure a shift towards the interior of the tube and an upper bent portion, substantially in the form of a semi-cylinder 269 which straddles the top of the lateral wall 180 of the frame 160. This bimetallic component comprises two superimposed and welded parallel laminae, one 274 of which presents a low expansion coefficient and the other 284 of which presents a higher thermal expansion coefficient. At the lower end of the straight portion 268, the free face of the lamina 274 is joined by a sealing 185 to the lower face of the belt 180 of the frame 190 adjacent to its junction to its base 190. At the end of the bent portion 169, the free face of this portion which is turned towards the outside, is joined by means of another sealing 241 to the internal face of the skirt 24.

During heating of the bimetallic components 246 by the edge of the mask 12 the bent portion 269 tends to coil up or to fold back even more, as indicated by arrows U and W. On the contrary, the straight portion 268 presents, on the one hand, a tendency to shift towards the exterior while sloping towards the upper edge of the frame 160 and, on the other hand, a tendency to straighten up at the site of the two opposite folds 290 and 291. This is respectively indicated by two arrows V and Z. The movement in the direction of the arrow V having the greater amplitude, it will thus be predominant and will encourage the expansion of the mask. The elongation of the straight section 268 in the direction of the arrow Z will substantially compensate the winding on itself of the semi-cylindrical portion (component according to arrow U).

Figure 16:
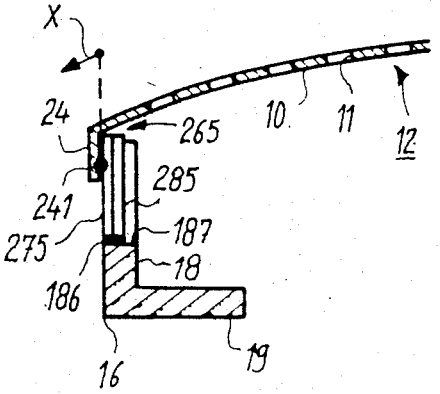
Figure 17:
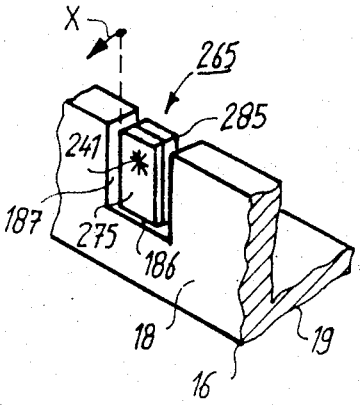

In the example of FIGS. 16 and 17, a frame 16 is also utilized, the substantially flat lateral wall 18 (without hollows or projections) is provided with cut-outs in steps 187 allow to position therein rectangular flat bimetallic strips 265, each comprising a low expansion lamina 275 and a high expansion lamina 285, superimposed and welded together along the whole of their interface, similar to bimetallic components 260, 262 and 263 of FIGS. 7, 11 and 13.

The bottom of the step 187 is flat and parallel to the base 19 of the frame 16 so as to be able to bear the lower end of the bimetallic strip 265 which is joined to this bottom by a welding seam 186.

In order that a heating of the component 265 results in a bending so that its free end is displaced towards the outside according to the arrow X, the lamina 275 is turned towards the outside and the lamina 285 towards the inside of the axis of the tube.

The free face of the low expansion lamina 275 can be disposed in alignment with the external face of the lateral wall of the belt 18 or slightly projecting with respect to it, the internal face of the skirt 24 of the mask 12 being joined by a sealing 241 to the upper portion of the external face of the bimetallic strips 265. When this face is coplanar with that of the belt 18, the internal face of the skirt 24 can be in contact with the external face of the belt 18 at the beginning of operating of the tube, which eventually allows to ensure a more rapid initial heating of the frame 16, especially with respect to the horizontal lateral arms (left and right).

In the embodiments represented in FIGS. 10, 11, 16 and 17, in which the frame 16 is provided with steps in which to house the bimetallic strips 262 or 265, this is weakened by the cut-outs and should present a sufficient thickness to compensate the weakening. In the other embodiments, such as those of FIGS. 3, 5, 6, 8, 12 and 14, the utilization of a light frame 160 can be advantageous from the point of view, on the one hand, of the reduction of the temporary swelling as to its amplitude and its duration, and on the other hand, of the compensation of the overall expansion of the frame and the mask, generally ensured by classical bimetallic strips assemblies, with which are provided the suspension springs of the frame at the frontal sheet of the tube, since the more rapid rise in temperature of the light frame encourages that of the bimetallic strip components to which they are welded.

Figure 18:
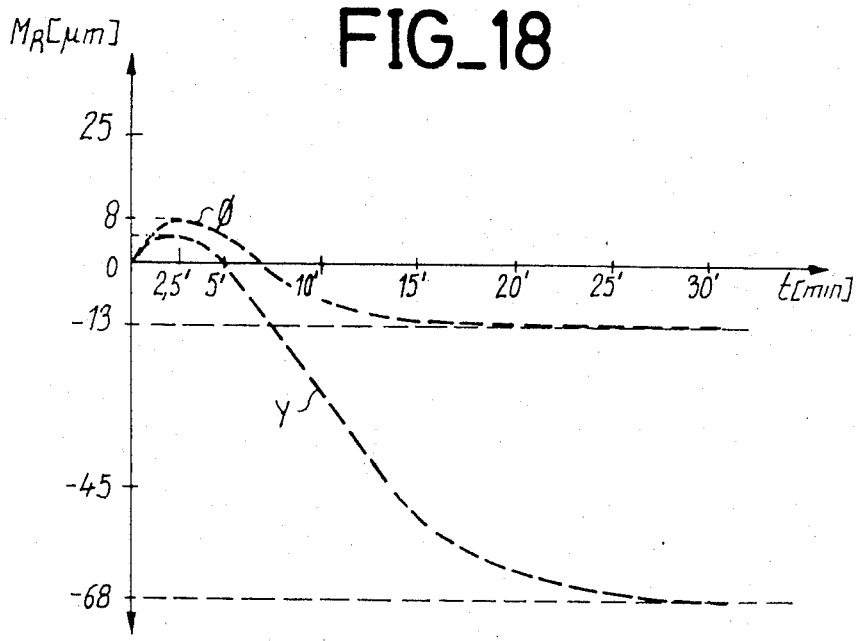
FIG. 18 shows diagrams of variations of the register losses as a function of operating time of the tube.

The effects of the bimetallic components 26 or 260 on the behavior of the mask 12, i.e. register defect variation $M_R$ with operating time t is illustrated in FIG. 18.

In abscissae the time $t=0$ corresponds to the operating of the tube and in ordinates the alignment defect or register defect $M_R$ is measured by the shift of the axis of a narrow excitation beam of a single color with respect to the vertical median axis of the band of luminescent material of the same color for a point situated on the horizontal median axis of the screen, generally half-way between the center and the edge of the trichrome lined screen. A radial shift towards the center is positive and towards the edge negative.

The curves shown in FIG. 18 have been compiled for a rise in temperature from 25° to 55° C. The curve Y corresponds to a mask-plus-frame assembly according to the invention but without classical compensating means ensuring the moving together of the mask-plus-frame assembly of the screen by its axial displacement towards the fore while the curve $\phi$ refers to a mask-plus-frame assembly according to the invention with, furthermore, classical compensating means constituted by bimetallic strips between the frame and the suspension springs to the glass sheet.

From FIG. 18 is can be deduced that the bimetallic strips between the frame and the mask disposed according to FIG. 5 allow to reduce the register defect (here positive) due to the temporary swelling, but without the compensating means between the frame and the glass sheet, the overall expansion of the frame-plus-mask assembly reached after 30 minutes remains high. The disposition of the known compensating means increases very slightly the temporary swelling (positive value of $M_R$) but brings back the overall expansion to a low value.

I claim:

1. A color cathode ray tube comprising: a perforated mask for the selection of colors in order that an electron beam intended for a particular color only reaches, on the screen, the luminescent material of that color, the mask presenting an edge fixed to a frame through intermediate bimetallic strips, the frame being integral with the internal face of the glass wall of the tube adjacent to the screen, wherein the bimetallic strips between the edge of the mask and the frame are disposed along the length of the vertical sides, with a bimetallic strip located substantially at the center of each of these vertical sides and bimetallic strips located adjacent to the corners, the bending of the bimetallic strips adjacent to the corners being greater than the bending of the bimetallic strips at the substantially central position on the vertical sides.

2. Tube according to claim 1, wherein the screen presents continuous vertical bands of luminescent material, the horizontal edges of the mask being attached to corresponding parts of the frame through intermediate welding spots, without bimetallic strips, on said horizontal edges.

3. Tube according to claim 2, wherein, on each horizontal side, a welding spot attaching the edge of the mask to the frame is located substantially in the central position with two other welding spots being symmetrically positioned with respect to the central position.

4. Tube according to claim 1, wherein, for the bimetallic strips fixing the edge of the mask to the frame, each bimetallic strip comprises a first and second parallel end portions, the first portion being pressed against the edge of the mask and the second portion being pressed against a corresponding wall of the frame, the first and second portions being separated by an extension so that the first portion of the bimetallic strip is separated from the corresponding wall of the frame.

5. Tube according to claim 1, wherein, for the bimetallic strips fixing the edge of the mask to the frame, each bimetallic strip comprises a flat plate having first and second ends, the first end being welded to an internal projection of the frame and the second end being welded to the edge of the mask so as to provide a space between the corresponding wall of the frame and the second end of the bimetallic strip.

6. Tube according to claim 1, wherein the bimetallic strips have a flat shape having a first end welded to the bottom of a wall of the frame and a face of a second end welded to the edge of the mask, the width of the wall being greater than the width of the corresponding bimetallic strip.

7. Tube according to claim 1, wherein each bimetallic strip presents a bent portion staggering a section of one wall of the frame.

8. A color cathode ray tube comprising: a perforated mask for the selection of colors in order that an electron beam intended for a particular color only reaches, on the screen, the luminescent material of that color, the mask presenting an edge fixed to a frame through intermediate bimetallic strips, the frame being integral with the internal face of the glass wall of the tube adjacent to the screen, wherein the bimetallic strips between the edge of the mask and the frame are disposed along the length of the vertical sides, with a bimetallic strip located substantially at the center of each of these vertical sides and dimetallic strips located adjacent to the corners, each bimetallic strip being formed of two blades having thermal expansion coefficients of different values, the difference between the expansion coefficients of the blades of the bimetallic strip at the substantially central position on the vertical sides is smaller than the difference between the expansion coefficients of the bimetallic strips adjacent to the corners, whereby the bending of the bimetallic strips adjacent to the corners being greater than the bending of the bimetallic strips of the substantially central position on the vertical sides.

9. A color cathode ray tube comprising: a perforated mask for the selection of colors in order that an electron beam intended for a particular color only reaches, on the screen, the luminescent material of that color, the mask presenting an edge fixed to a frame through intermediate bimetallic strips, the frame being integral with the internal face of the glass wall of the tube adjacent to the screen, wherein the bimetallic strips between the edge of the mask and the frame are disposed along the length of the vertical sides, with a bimetallic strip located substantially at the center of each of these vertical sides and bimetallic strips located adjacent to the corners, the bimetallic strips adjacent to the corners have different lengths from those of the bimetallic strips in the substantially central positions, the bending of the bimetallic strips adjacent to the corners being greater than the bending of the bimetallic strips at the substantially central position on the vertical sides.

* * * * *